US006393878B1

(12) United States Patent
Fayngersh et al.

(10) Patent No.: US 6,393,878 B1
(45) Date of Patent: May 28, 2002

(54) MORTISE LOCK

(75) Inventors: Zakhary Fayngersh, West Hartford; Damon J. Lenk, Bristol, both of CT (US)

(73) Assignee: Corbin Russwin, Inc., Berlin, CT (US)

( * ) Notice: Subject to any disclaimer, the term of this patent is extended or adjusted under 35 U.S.C. 154(b) by 0 days.

(21) Appl. No.: 09/577,057

(22) Filed: May 22, 2000

(51) Int. Cl.[7] ..... E05B 59/00; E05B 63/14

(52) U.S. Cl. ..... 70/107; 70/10; 70/11; 70/106; 292/169.14; 292/169.17; 292/335

(58) Field of Search ..... 70/10, 11, 12, 70/86, 107, 143, 106, 142; 292/169.14, 169.17, 335, 336

(56) References Cited

U.S. PATENT DOCUMENTS

| | | | | |
|---|---|---|---|---|
| 168,986 | A | 10/1875 | Griscom | |
| 197,531 | A | 11/1877 | Vetter | |
| 286,580 | A | 10/1883 | Billings | |
| 302,657 | A | 7/1884 | Heizmann et al. | |
| 950,108 | A | 2/1910 | Lawrence | |
| 1,057,663 | A | 4/1913 | Page | |
| 1,126,181 | A | 1/1915 | Cleaver | |
| 1,469,829 | A | 10/1923 | Teich | |
| 1,627,420 | A | 5/1927 | Thomas | |
| 2,516,991 | A | 8/1950 | Heyer | 292/244 |
| 2,823,538 | A | 2/1958 | Fresard | 70/462 |
| 3,211,486 | A | 10/1965 | Crandell | 292/348 |
| 3,235,301 | A | 2/1966 | Russell et al. | 292/244 |
| 3,242,706 | A | 3/1966 | Check | 70/110 |
| 3,257,136 | A | 6/1966 | Russell et al. | 292/244 |
| 3,361,462 | A | 1/1968 | Foster | 292/245 |
| RE26,677 | E | 10/1969 | Russell et al. | 292/34 |
| 3,631,695 | A | 1/1972 | Velbert et al. | 70/432 |
| 3,672,714 | A | 6/1972 | Schultz | 292/34 |
| 3,750,433 | A | 8/1973 | Sanders | 70/146 |
| 3,769,822 | A | 11/1973 | Yulkowski | 70/107 |
| 3,808,849 | A | 5/1974 | Alexander | 70/149 |
| 3,898,822 | A * | 8/1975 | Schalm | |
| 4,071,270 | A | 1/1978 | Alexander | 292/169.22 |

(List continued on next page.)

FOREIGN PATENT DOCUMENTS

| | | | |
|---|---|---|---|
| DE | 1938639 | 2/1971 | E05B/45/01 |
| DE | 2031370 | 12/1971 | E05B/63/04 |
| DE | 2136636 | 2/1973 | E05B/63/04 |
| DE | 1938639 | 5/1978 | E05B/63/04 |
| DE | 2160563 | 9/1979 | E05B/63/04 |
| DE | 2827939 | 1/1980 | E05B/63/04 |
| NO | 63812 | 8/1941 | 68/62 |
| WO | 9425709 | 11/1994 | E05B/15/02 |

*Primary Examiner*—Gertrude Arthur
(74) *Attorney, Agent, or Firm*—Moore & Van Allen PLLC; Michael G. Johnston

(57) ABSTRACT

A mortise lock is provided including a housing for a latch bolt and a deadbolt which are mounted in the housing for movement between a retracted position where the latch bolt and deadbolt are inside the housing and an extended position where a portion of the latch bolt and deadbolt extend from the housing. A key-operated cylinder in the housing operates to move the deadbolt between the retracted and extended positions. A latch operator is also provided for retracting both the latch bolt and the deadbolt. A moveable blocking element in the housing prevents movement of the latch operator in one position of the blocking element. A locking lever operatively connects the deadbolt and the blocking element so that when the deadbolt is extended the blocking element is automatically moved to the position blocking the latch operator. The locking lever comprises an arm member integral with the locking lever. A latch lever operatively connects the key-operated cylinder and the arm member of the locking lever when the blocking element is in the blocking position for moving the blocking element out of the blocking position by operation of the key-operated cylinder.

20 Claims, 15 Drawing Sheets

U.S. PATENT DOCUMENTS

| | | | | | |
|---|---|---|---|---|---|
| 4,118,056 | A | | 10/1978 | Alexander | 292/169.17 |
| 4,195,504 | A | * | 4/1980 | Foshee | |
| 4,243,256 | A | | 1/1981 | Frydrych | 292/245 |
| 4,286,812 | A | | 9/1981 | Sprekeler | 292/245 |
| 4,389,061 | A | | 6/1983 | Foshee | 262/169.14 |
| 4,462,230 | A | | 7/1984 | Evans | 70/383 |
| 4,468,059 | A | | 8/1984 | Nelson et al. | 292/337 |
| 4,470,278 | A | | 9/1984 | Hale et al. | 70/134 |
| 4,470,279 | A | | 9/1984 | Neary et al. | 70/134 |
| 4,572,556 | A | * | 2/1986 | Foshee | |
| 4,583,382 | A | | 4/1986 | Hull | 70/107 |
| 4,674,776 | A | | 6/1987 | James | 292/40 |
| 4,695,082 | A | | 9/1987 | Marks | 292/169.16 |
| 4,696,174 | A | | 9/1987 | Marks | 70/451 |
| 4,798,065 | A | | 1/1989 | DeForrest, Sr. | 70/129 |
| 4,817,404 | A | | 4/1989 | Eisermann et al. | 70/134 |
| 4,890,870 | A | | 1/1990 | Miron | 292/333 |
| 4,950,005 | A | | 8/1990 | Cudd | 292/150 |
| 4,988,133 | A | | 1/1991 | Shih | 292/191 |
| 5,201,200 | A | | 4/1993 | Hauber | 70/107 |
| 5,308,131 | A | | 5/1994 | Galindo et al. | 292/337 |
| 5,395,144 | A | | 3/1995 | Galindo | 292/169 |
| 5,604,970 | A | | 2/1997 | Aigner et al. | 29/525 |
| 5,676,407 | A | | 10/1997 | Smallegan et al. | 292/139 |
| 5,678,870 | A | | 10/1997 | Pelletier | 292/244 |
| 5,820,177 | A | | 10/1998 | Moon | 292/335 |

* cited by examiner

MORTISE LOCK

BACKGROUND

This invention relates generally to mortise locks, and more particularly to a mortise lock for use where a high level of security is desired.

A mortise lock is designed to fit into a mortised recess formed in the edge of a door which is opposite to the edge of the door that is hinged to the door frame. The mortise lock generally includes a rectangular housing, or case, which encloses the lock components. The principal lock component is a beveled latch bolt which projects beyond the edge of the door and into an opening in the door frame to latch the door in a closed position. The latch bolt is moveable to a retracted position inside the case to permit opening of the door by operation of a latch operator, such as a door knob or lever handle.

Mortise locks are typically configured so that the latch operators mounted on the inside and outside surfaces of the door can operate independently. The outside latch operator can either be rotated to retract the latch bolt, or locked against rotation to prevent retraction of the latch bolt. Preferably, the inside latch operator can always be rotated to retract the latch bolt. The locking of the outside latch operator is usually controlled by a manual actuator, such as, for example, push buttons or a pivoted toggle, which is exposed at the edge of the mortise lock near the latch. The manual actuator has an associated link within the mortise lock case which, in one position of the manual actuator, engages a moveable portion of the outside latch operator inside the lock case so as to prevent rotation of the latch operator. In a second position, the link disengages from the moveable portion thus permitting rotation of the outside latch operator. The inside latch operator is usually unaffected by the manipulation of the manual actuator and remains rotatable at all times.

Adjustments must be made to the mortise lock depending on whether the lock is mounted in a left-hand or right-hand door. A mortise lock mounted in a left-hand door must be rotated 180° about a vertical axis for mounting in a right-hand door. Consequently, the latch bolt must also be rotated 180° about a horizontal axis so that the beveled face of the latch faces the door-closing direction. In addition, the inside and outside latch operators of the left-hand door mounted lock become the outside and inside latch operators, respectively, of the right-hand door mounted lock. Therefore, a change must be made if the latch operator controlled by the locking mechanism happens to be the inside latch operator when the lock is installed.

The necessary adjustments to the mortise lock can be accomplished without opening the case. Typically, the latch bolt can be pulled partially out of the housing, usually against the force of a spring, rotated 180° and then allowed to be pulled back into the housing by the spring. However, this arrangement can lead to tampering after the lock is installed since the latch bolt can be reversed even when the mortise lock is in the door, which would prevent the door from closing. Moreover, conventional mechanisms for reversing the operation of the locking mechanism are complicated and difficult to manipulate.

Further, some mortise lock applications require a high degree of security, including government buildings, banks, prisons and storage facilities, as well as other applications where a higher degree of security may be desired. The latter may include institutional settings such as schools, and in particular classrooms. A typical classroom function mortise lock includes a latch bolt operable by an inside or outside lever handle. The outside lever handle may be locked against rotation by a key-operated cylinder in the outside of the door. A significant problem with this arrangement is that the latch can only be locked from the outside. As a result, if a teacher inside the room wants to lock the door, she must open the door to operate the outside cylinder.

For the foregoing reasons, there is a need for a mortise lock for use in applications where a high degree of security is preferred. The new, high security mortise lock should be lockable from the inside of the door. The new lock should also conveniently handle high traffic use. Ideally, the high security mortise lock is reversible and the latch assembly for use in the lock includes a latch bolt that cannot be reversed after the lock is installed in a door. Reversal of the latch bolt for use with a door of the opposite hand should be easily accomplished in the field. Any corresponding changes in the locking mechanism during reversal to effect locking of the outside latch operator should also be uncomplicated. The new latch assembly and locking mechanism should be straightforward to manufacture and use.

SUMMARY

Therefore, it is an object of the present invention to provide a high security mortise lock, particularly for use in institutional applications such as schools.

Another object of the present invention is to provide a high security mortise lock which can be locked from the inside of the door.

Still another object of the present invention is to provide a high security reversible mortise lock wherein the latch assembly cannot be reversed when the lock is installed on the door.

A further object of the present invention is to provide a new latch assembly and locking mechanism for a high security mortise lock which are simple to reverse in the field prior to installation in the door.

According to the present invention, a mortise lock includes a housing for a latch bolt and a deadbolt which are mounted in the housing for movement between a retracted position where the latch bolt and deadbolt are inside the housing and an extended position where a portion of the latch bolt and deadbolt extend from the housing. First means are provided for moving the deadbolt between the retracted and extended positions. Second means, including a moveable member in the housing, are provided for retracting both the latch bolt and the deadbolt. A blocking element is mounted in the housing for movement between a first position and a position where the blocking element prevents movement of the moveable member. A locking lever operatively connects the deadbolt and the blocking element so that when the deadbolt is extended the blocking element is automatically moved to the position blocking the moveable member. A latch lever operatively connects the deadbolt moving means and the locking lever when the blocking element is in the blocking position for moving the blocking element out of the blocking position by operation of the first moving means. The first deadbolt moving and latch retracting means may comprise a key-operated cylinder.

Also according to the present invention, a security mechanism for a mortise lock is provided. The mortise lock is of the type comprising a housing for accommodating the lock components including the security mechanism, a latch bolt and deadbolt mounted in the housing for movement relative to the housing between extended and retracted positions, first means for moving the deadbolt between the retracted and extended positions of the deadbolt, second means, including a moveable member, for moving the latch bolt and the deadbolt to the retracted position, a blocking element mounted in the housing for movement between a first position and a position where the blocking element prevents movement of the moveable member, and a locking lever operatively connecting the deadbolt and the blocking element so that when the deadbolt is moved from the retracted position to the extended position of the deadbolt element is moved to the blocking position. The security mechanism comprises an arm member integral with the locking lever and a latch lever which operatively interengages the first moving means and the arm member when the blocking element is in the second position of the blocking element and the deadbolt is in the retracted position of the deadbolt so that the blocking element is moveable to the first position by operation of the first moving means.

In accord with the present invention, a latch assembly comprises a latch bolt having a first portion adapted to project from an opening in the lock housing in an extended position of the latch bolt while a second portion of the latch bolt remains within the lock housing. The latch bolt is removable from the lock housing through the opening. A securing member inside the housing is releasably attached to the second portion of the latch bolt. The securing member comprises a securing element having a blocking surface and means for biasing the securing element and blocking surface into engagement with the second portion of the latch bolt for releasably securing the latch bolt to the moving member. The securing element further comprises a disengaging surface which when moved against the force of the biasing means releases the second portion of the latch bolt from the securing member so that the latch bolt may be removed from the lock housing.

In further accord with the present invention, a mortise lock of the type having a latch bolt normally projecting from the lock housing and means including a moveable member in the lock housing connected to a door knob or lever handle for moving the latch bolt to a retracted position in the housing, has a locking mechanism comprising a blocking element in the housing and means for moving the blocking element between a locked position and an unlocked position relative to the moveable member. The blocking element has an opening adapted to receive a portion of the moveable member when the blocking element is in the locked position for allowing the moveable member to move and the door knob or lever handle to rotate. A stop is removably positioned in the opening of the blocking element for preventing movement of the moveable member when the blocking element is in the locked position.

Also in accord with the present invention, a mortise lock comprises a housing and a latch bolt removably mounted in the housing through an opening in the housing. A securing member is disposed inside the housing for movement relative to the housing. The securing member comprises a securing element having a blocking surface and means for biasing the blocking surface into engagement with the latch bolt for releasably securing the latch bolt to the securing member. The securing element further comprises a surface which when pressed moves the securing element against the force of the biasing means for releasing the latch bolt from the securing member so that the latch bolt may be removed from the housing. The securing member is moveable between a first position where the latch bolt is inside the housing and a second position where a portion of the latch bolt projects through the opening in the housing. Means for moving the securing member to the first position are provided, including a moveable member in the housing. A blocking element is disposed in the housing and means are provided for moving the blocking element between a locked position and an unlocked position relative to the moveable member. A stop is removably attached to the blocking element and adapted in the locked position to prevent operation of the moveable member.

An important feature of the present invention is that a key-operated cylinder is provided on the inside of the door for moving the deadbolt and retracting the latch bolt. Thus, due to the operative connection between the latch lever and the blocking element, the lock may be locked from the inside of the door, which is particularly important in a classroom setting. Thus, the mortise lock of the present invention incorporates a deadbolt operation into a traditional classroom lock.

Another feature of the mortise lock is the releasing surface of the securing member is only accessible through the side walls of the mortise lock case. Therefore, latch bolt reversal must be performed before the lock is installed. Moreover, once the latch bolt is freed from the moveable member, the latch bolt can be completely removed from the lock housing, reversed and reinstalled. The blocking element and removable stop for locking the lock are also accessible through the side walls of the lock housing. Thus, repositioning of the stop in the blocking element is also accomplished before installation. Preferably, the stop is a threaded plug which is received in a threaded opening in the blocking element.

Further, reversal of the latch bolt and locking mechanism is simple to perform prior to installation of the lock. A screw driver is the only tool needed to release the latch bolt from the lock housing for reversal of the latch bolt and locking mechanism. Once the lock is installed in a door, the latch bolt cannot be reversed because the latch bolt cannot be removed from the lock. The lock must be removed from the door to perform the reversal process.

Additional objects, features and advantages of the present invention will be apparent from the following description in which references are made to the accompanying drawings.

BRIEF DESCRIPTION OF THE DRAWINGS

For a more complete understanding of the present invention, reference should now be had to the embodiments shown in the accompanying drawings and described below.

DESCRIPTION

The latch bolt and locking mechanism according to the present invention are for use in a mortise lock and may be used with any conventional mortise lock assembly such as, for example, the mortise lock assembly described by U.S. Pat. No. 4,118,056, the contents of which are hereby incorporated by reference. Accordingly, detailed explanations of the functioning of all of the mortise lock components are deemed unnecessary for understanding of the present invention by one of ordinary skill in the art.

Figure 1:
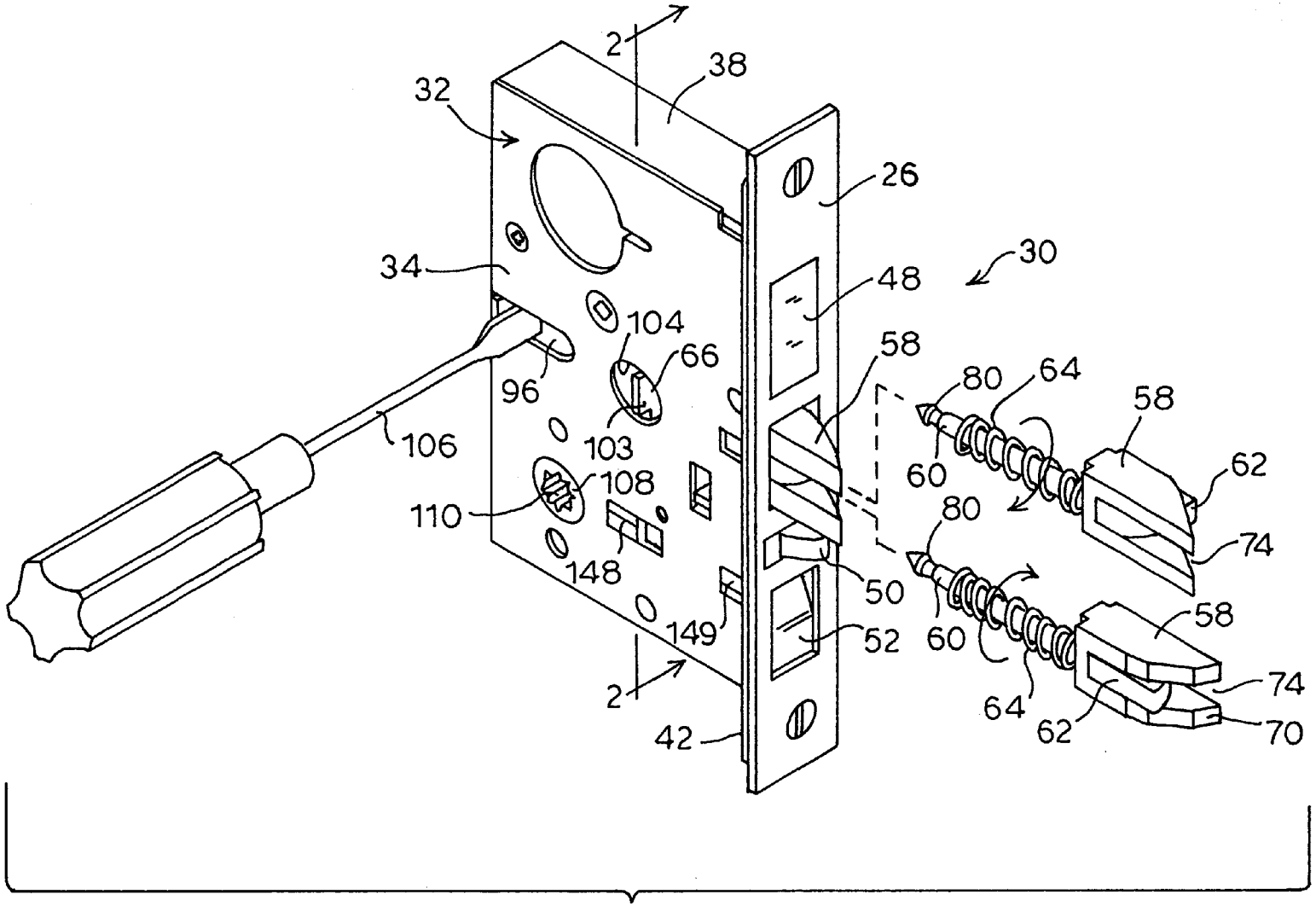
FIG. 1 is a perspective view of an embodiment of a mortise lock assembly according to the present invention.

Referring now to FIG. 1, a first embodiment of a mortise lock assembly according to the present invention is shown and is generally designated by reference numeral 30. The lock 30 comprises a generally rectangular box, or case 32, for housing the lock components and is adapted to be received in a mortise in the free, or unhinged, edge of a door. One of the side walls of the case 32 comprises a cap 34 which is secured to and forms a closure for the case 32.

Figure 2:
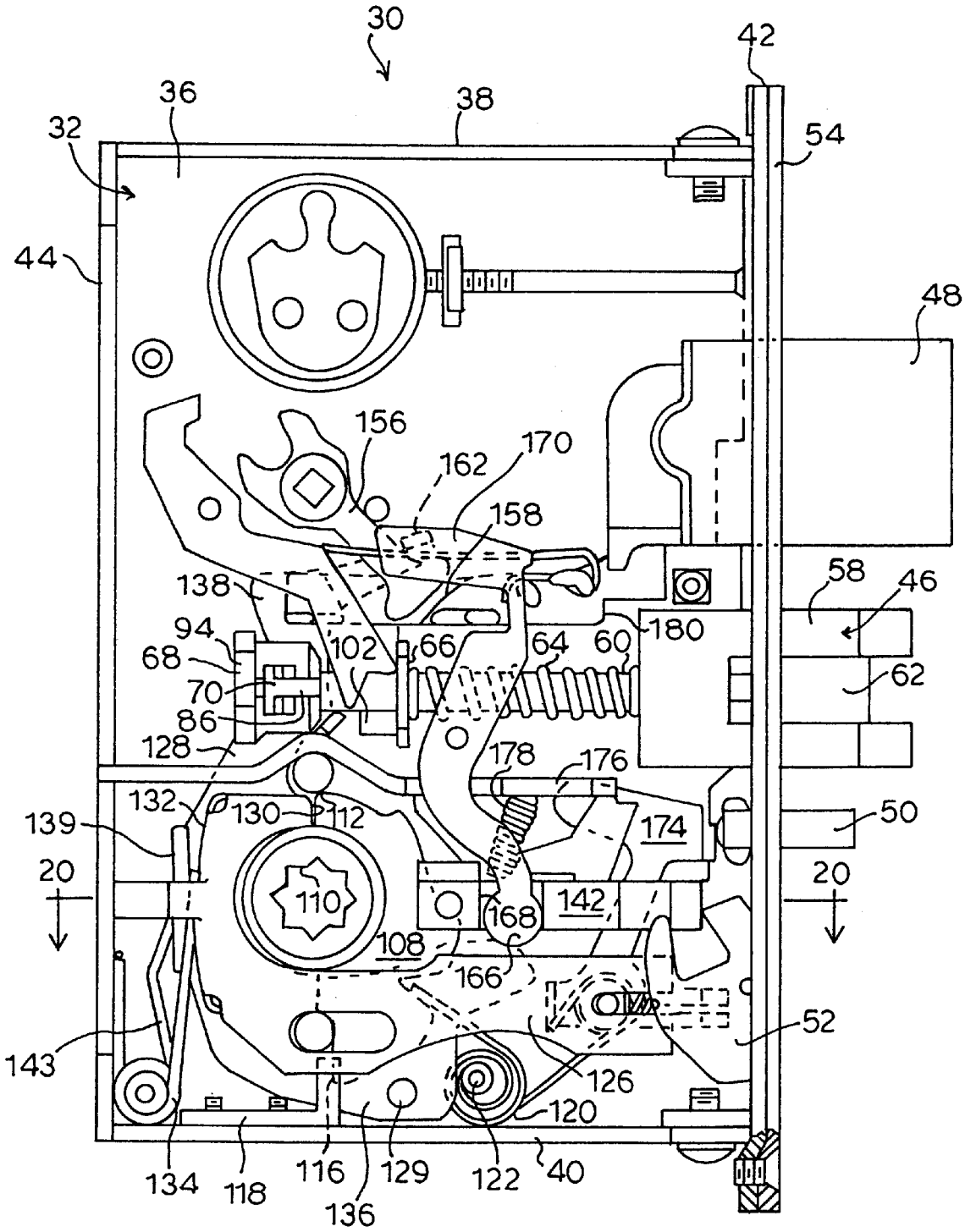
FIG. 2 is a side elevation view of the mortise lock assembly taken along line 2—2 of FIG. 1.

FIG. 2 shows the lock with the cap side wall 34 removed. The case 32 includes a side wall 36 and, as seen in FIG. 2, integral top 38, bottom 40, front 42 and rear 44 walls. The front wall 42 has openings for a latch bolt 46, a deadbolt 48, an auxiliary bolt 50 and a flush-mounted toggle 52. A face plate 54 is secured to the front wall of the case 32 and has openings which correspond to the openings in the front wall 42. The latch bolt 46, deadbolt 48 and auxiliary bolt 50 are shown projecting from their respective openings in the front wall 42 and face plate 54.

Figure 3:
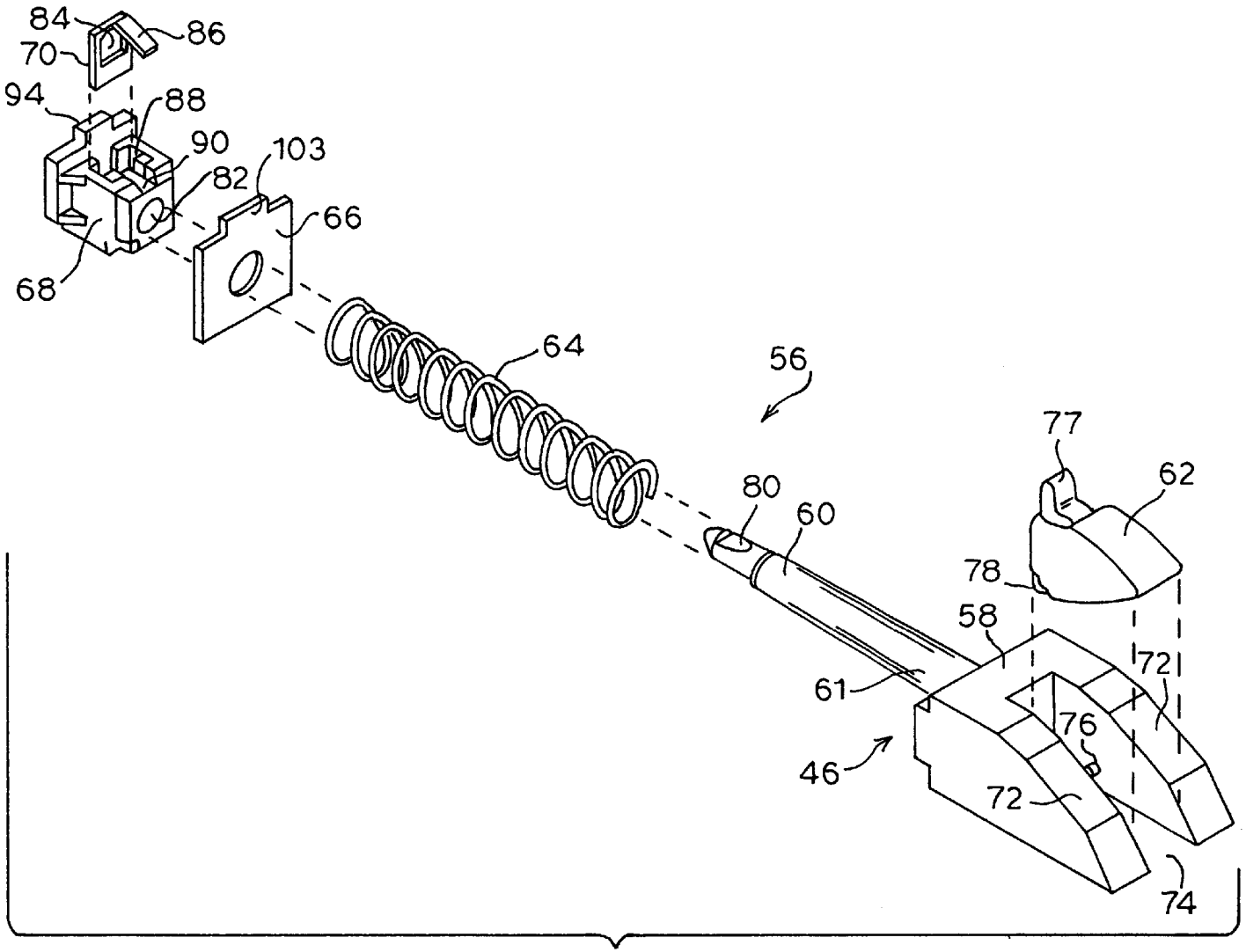
FIG. 3 is a perspective exploded view of an embodiment of a latch assembly used in the mortise lock assembly of FIG. 1.
Figure 12:
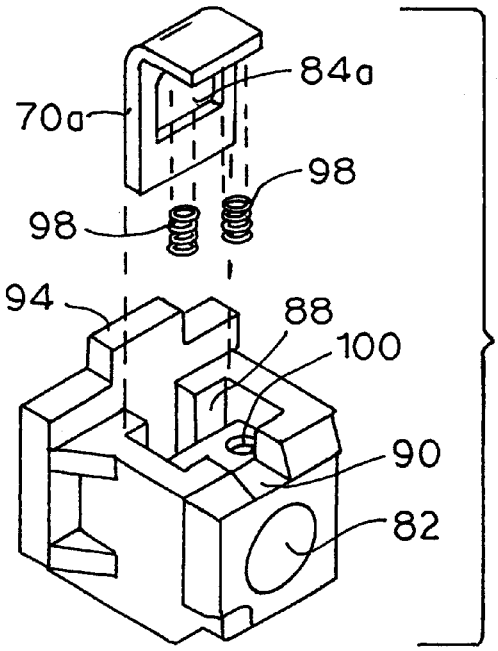
FIG. 12 is an exploded perspective view of an alternative embodiment of a tail plate and spring clip for use in the latch assembly of FIG. 3.

An embodiment of the latch assembly for use in the mortise lock assembly of FIG. 2 is shown in FIG. 3 and designated generally at 56. The latch assembly 56 comprises the latch bolt 46 including a bolt head 58 and an integral latch tail 60, an anti-friction latch 62, a coil spring 64, a spring flange 66, a tail plate 68 and spring clip 70. The bolt head 58 includes a beveled face 72 and a slot 74. A short pin 76 extends from one side of the bolt head 58 and into the slot 74 for pivotally mounting the anti-friction latch 62.

Figure 5:
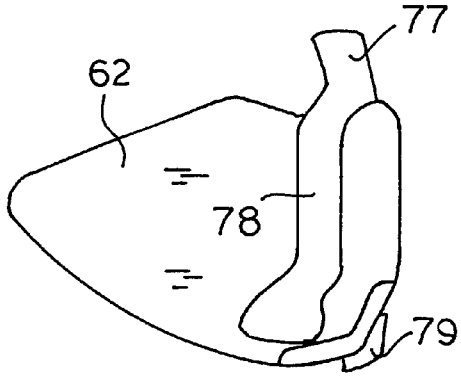
FIGS. 4 and 5 are opposite side elevational views of an anti-friction latch used in the latch assembly of FIG. 3.
Figure 4:
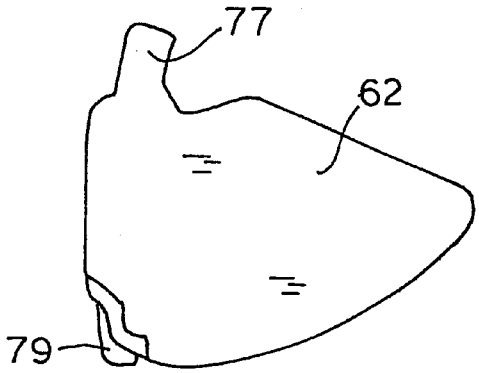

The anti-friction latch 62 is shown in more detail in FIGS. 4 and 5. As seen in FIG. 5, one side of the anti-friction latch 62 has a groove 78 for receiving the pin 76 when the antifriction latch 62 is slipped into the slot 74 during manufacture. The groove 78 is closed near its open end in a press operation to keep the anti-friction latch 62 in the bolt head 58. A lever 77 extends from one side of the anti-friction latch and a stub 79 extends from the opposite side. When the latch assembly 56 is in the case (FIG. 2), the anti-friction latch 62 and the opening for the latch bolt 46 in the front wall 42 of the case 32 are configured so that the lever 77 engages behind the front wall 42 while the stub 79 engages behind the face plate 54.

Returning to FIG. 3, the latch tail 60 extends from the rear of the bolt head 58. The portion 61 of the latch tail 60 adjacent the bolt head 58 is thicker than the free end so that the coil spring 64 must be forced onto that portion of the latch tail thereby holding the coil spring 64 on the latch tail 60. The free end of the latch tail 60 is rounded and includes a notch 80 longitudinally spaced from the free end. The tail plate 68 is generally cube-shaped and has a pass-through opening 82 for receiving the free end of the latch tail 60. The spring clip 70 is a flat rectangular piece defining an irregular opening 84 and having an angled tab 86 extending from one edge of the clip 84. The tail plate 68 has a slot 88 which intersects the tail plate opening 82 for receiving the spring clip 70. The spring clip tab 86 fits in a groove 90 in the side of the tail plate 68.

Figure 6:
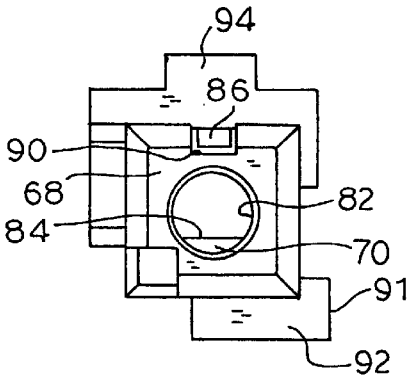
FIGS. 6 and 7 are front and rear elevational views, respectively, of the latch tail and spring clip of FIG. 3.
Figure 7:
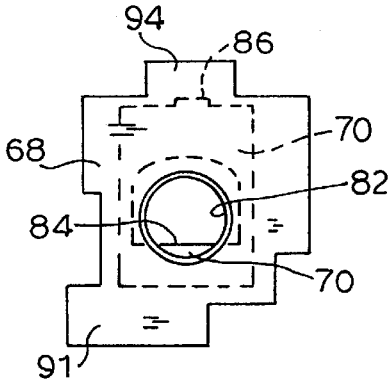
Figure 13:
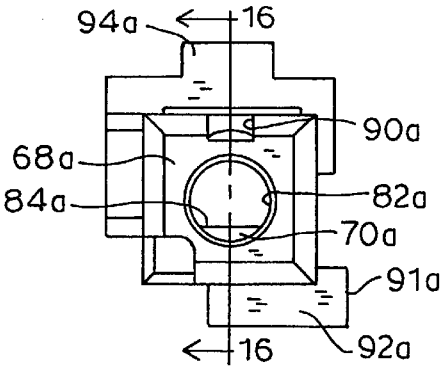
FIGS. 13 and 14 are front and rear elevational views, respectively, of the tail plate and spring clip embodiment of FIG. 12 similar to FIGS. 6 and 7.
Figure 14:
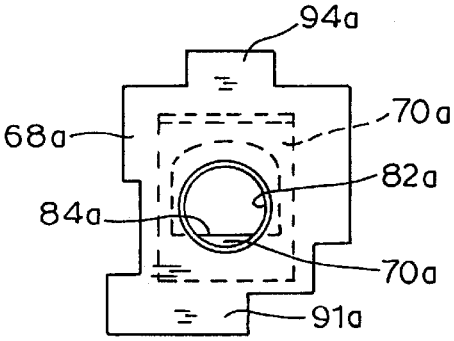
Figure 8:
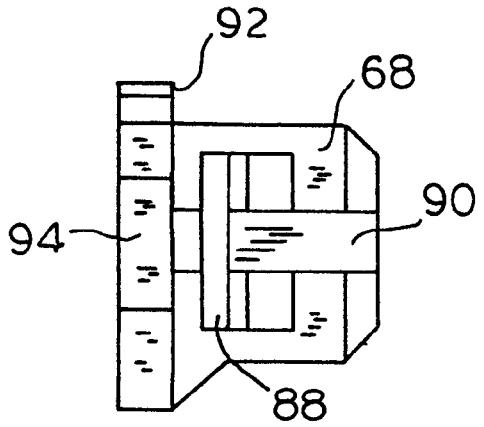
FIGS. 8, 9, 10 and 11 are side elevational views of the tail plate of FIG. 3.

Each side of the tail plate 68 is shown in FIGS. 6 through 11. The tail plate 68 has a support boss 91 which sits against the case side wall 34 when the tail plate 68 is in the case 32. The support boss 91 has a retraction surface 92. An opposed boss 94 fits in a linear guide slot 96 in the cap side wall 14 (FIG. 1) for guiding and supporting linear movement of the tail plate 68. Referring particularly to FIGS. 6 and 7, the tail plate 68 is shown from the front and rear, respectively, with the spring clip 70 in the slot 88 in the tail plate 68. The irregular opening 84 in the spring clip 70 aligns with the opening 82 in the tail plate 68. The dimensions of the spring clip 70 and the position of the slot 88 are such that the spring clip 70 partially blocks the opening 82 through the tail plate 68. The tab 86 is braced against the surface of the groove .90 in the tail plate 68 to bias the spring clip 70 upward to this position as seen in FIGS. 6 and 7.

Figure 10:
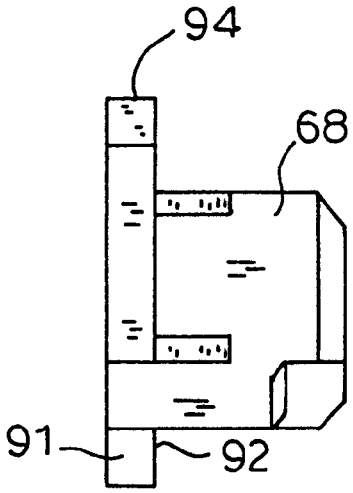
Figure 9:
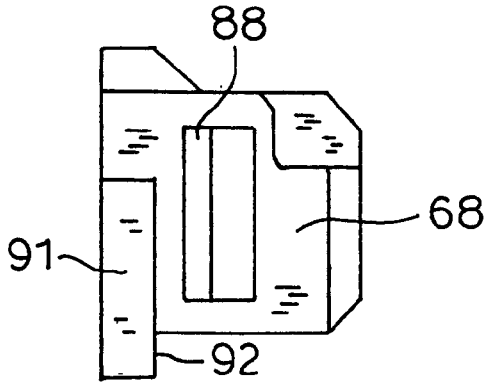
Figure 11:
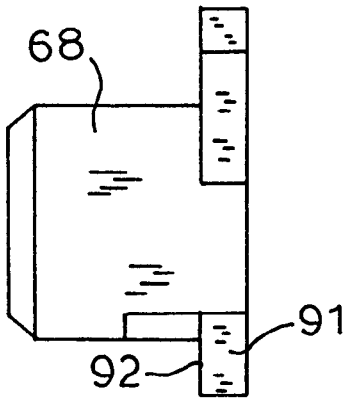
Figure 15:
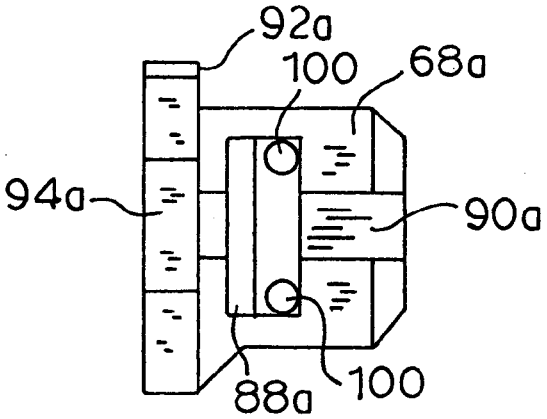
FIG. 15 is a side elevational view of the tail plate embodiment of FIG. 12 similar to FIG. 8.

An alternative embodiment of the tail plate 68*a* and spring clip 70*a* for use in the latch assembly 56 of the present invention is shown in FIGS. 12 through 15. In this embodiment, the spring clip 70*a* is L-shaped and has an irregular opening 84*a*. Two coil springs 98 are disposed in depressions 100 (FIG. 15) in the tail plate surface on either side of the groove 90*a* for biasing the spring clip 70*a* upward to the position shown in FIGS. 13 and 14 partially blocking the opening 82*a* in the tail plate 68*a*. The other sides of the tail plate 68*a* are configured the same as seen in FIGS. 9–11.

Figure 16:
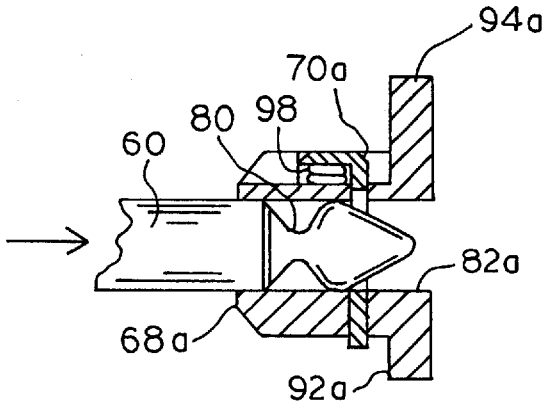
FIGS. 16 and 17 are side sectional views of the tail plate and spring clip embodiment of FIG. 12 showing the latch tail entering the tail plate taken along line 16—16 of FIG. 13.
Figure 17:
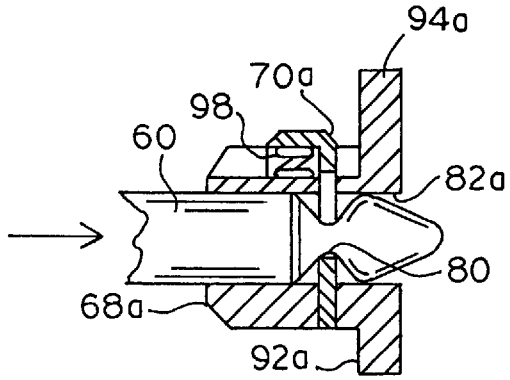

Connection of the latch bolt 46 to the tail plate 68*a* and spring clip 70*a* is shown in FIGS. 16 and 17. In FIG. 16, the free end of the latch tail 60 is shown entering the opening 82*a* in the tail plate 68*a*. As the latch tail 60 initially enters the tail plate 68*a*, the rounded end engages the edge of the opening 84*a* in the spring clip 70*a* forcing the clip down and compressing the springs 98. When the latch tail notch 80 passes the spring clip 70*a*, the springs 98 push the clip upward so that the edge of the opening 84*a* in the clip engages behind the notch 80 in the latch tail 60 securing the latch tail in the tail plate 68*a*. It is understood that the embodiments of the tail plate and spring clip in FIGS. 6 through 15 are exemplary and other structures are possible, as long as the function of the overall structure for releasably holding the latch tail in the tail plate is maintained.

As seen in FIG. 2, when the latch assembly 56 is in position in the mortise lock assembly 30, a substantial portion of the latch bolt 46 is inside the case 32 even when the latch bolt 46 is in the extended position with a predetermined portion projecting beyond the front of the case 32. The latch tail 60 extends rearwardly from the bolt head 58 through a guide slot formed in a boss 102 fixedly mounted between the side walls 34, 36 for guiding and supporting the linear reciprocal movement of the latch bolt 46. The coil spring 64 is held in compression between the bolt head 58 and the spring flange 66, which is urged against the boss 102, for normally biasing the latch bolt 46 outwardly to the extended position. A boss 103 on the spring flange 66 fits in a hole 104 (FIG. 1) in the cap side wall 34 for holding the flange 66 in position.

The latch bolt 46 is moveable in the openings in the front wall 42 of the case 32 and face plate 54 to the retracted position inside the case by operation of a latch operator comprising either an inside or outside knob or lever handle (not shown). In addition, the latch bolt 46 automatically retracts when the anti-friction latch 62 and the beveled face 70 of the bolt head 58 engage the door frame upon closing of the door. Initially, the anti-friction latch 62 engages the door frame pivoting the anti-friction latch on the pin 76 in the bolt head 58. As the anti-friction latch 62 pivots, the lever 77 works against the front wall 42 of the case 32 driving the latch bolt 46 rearward into the case 32. When the latch operator is released, such as when the door is in the door frame, the coil spring 64 returns the latch bolt 46 to the extended position.

Figure 18:
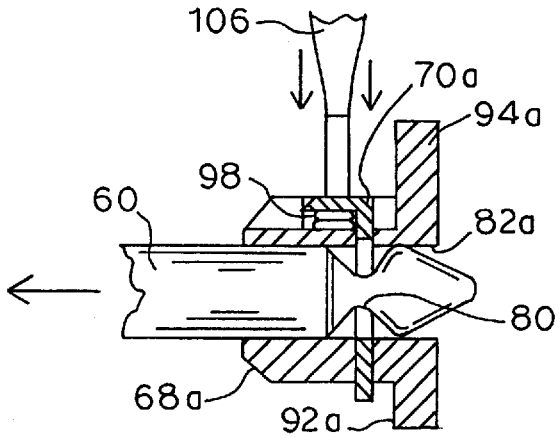
FIG. 18 is a side sectional view of the tail plate and spring clip embodiment of FIGS. 16 and 17 in combination with a screw driver blade illustrating the removal of the latch tail from the tail plate.

According to the present invention, the latch bolt 46 is reversible for use with a door of the opposite hand. In order to reverse the latch bolt 46, it is necessary to disconnect the latch bolt from the tail plate 68 and remove the latch bolt 46 from the lock assembly 10. This is accomplished by first removing the face plate 54 and then manually pushing the latch bolt 46 into the case 32. Next, the user manually depresses the spring clip 70, which is accessible through the guide slot 96 in the cap side wall 34. As seen in FIG. 18, by pressing on the spring clip 70*a* with a screw driver 106 or other tool, the spring clip 70*a* is pushed down against the force of the springs 98 thereby releasing the latch tail 60 from the spring clip 70*a* and tail plate 68*a*. When the latch bolt 46 is free of the tail plate 68*a*, the latch bolt 46 may be pulled through the opening in the front wall 42 of the case 32 (FIG. 1), rotated 180°, inserted into the case 32 and reattached to the tail plate 68*a*, as described above. The slot 96 and hole 104 in the cap side wall 34 are used for viewing to guide the latch tail 60 through the flange 66 and boss 102 and into the opening 82*a* in the tail plate 68*a*. Because the anti-friction latch 62 can pivot and move linearly with respect to the bolt head 58 on the pin 76, at least to the extent of the groove 78 which has not been pressed in, the latch bolt 46 is easily manipulated during removal and reinsertion. When the latch bolt 46 is again in the case 32 and attached to the tail plate 68*a*, the face plate 54 is reattached.

It is understood that other means for biasing the spring clip to the position where the spring clip partially blocks the tail plate opening are possible. For example, the spring clip embodiment shown in FIGS. 12 through 15 would work without the coil springs if the clip material was flexible enough to allow the clip to be pushed down to clear the tail plate opening. Thus, we do not intend ourselves to limit to the specific embodiments of the spring clip biasing means shown herein.

Figure 19:
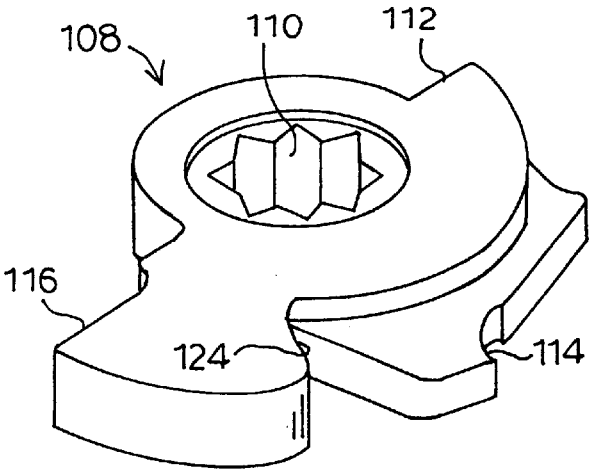
FIG. 19 is a perspective view of a hub used in the mortise lock assembly of FIG. 1.

As noted above, the latch operator comprises means for retracting the latch bolt 46 including an inside or outside knob or lever handle. The retracting means comprises two independent, coaxial rollback hubs 108 which are mirror images of one another. The hubs 108 are rotatably mounted in opposed holes in the walls 34, 36 of the case 32 below the latch assembly 56 (FIG. 2). The hub 108 which fits in the case side wall 36 is shown in FIG. 19. The hubs include a star-shaped aperture 110 for non-rotatable connection to inside and outside spindle drives (not shown) connected to the knobs or lever handles for rotating the hubs 108. Each hub 108 has an upper rollback surface 112 which faces the rear wall 44 of the case 32, a forwardly extending boss 114 and downwardly depending legs 116. As seen in FIG. 2, the legs 116 engage an L-shaped bracket 118 attached to the bottom of the case 32 for preventing clockwise rotation (as seen in FIG. 2) of the hubs 108. Two torsion springs 120 are mounted on a transverse pin 122 adjacent to the front of each hub 108. An end of each spring 120 fits in a notch 124 (FIG. 18) in the hubs 108 for restoring the hubs to the neutral or home position when the knob or handle is released. It is understood that, as an alternative, the mortise lock assembly may have a single hub to which both the inside and outside spindle drives are connected.

The retracting means also includes a retractor shoe 126 and a hub lever 128. The shoe 126 is mounted for linear movement within the case 32 and has a forwardly facing bearing surface 130 for engaging the rollback surfaces 112 of the hubs 108 and a rearwardly facing bearing surface 132. In this arrangement, the shoe 126 moves linearly rearward in response to counterclockwise rotation, as seen in the FIGS., of either of the rollback hubs 108. A torsion spring 134 acts between the rear wall 44 and the retractor shoe 126 to urge the shoe toward engagement with the roll back hubs 108.

The hub lever 128 comprises a generally flat, L-shaped lever disposed within the case 32 against the case side wall 36. The hub lever 128 is pivotally supported on a pin 129 at its lower forward leg 136 below and in front of the hubs 108. The upper leg 138 of the hub lever 128 extends upwardly to the rear of the hubs 108 and has a first laterally projecting tab 139 adjacent the rearward bearing surface 132 of the shoe 126. A portion of the upper leg of 138 of the hub lever 128 is adjacent to the retraction surface 92 of the tail plate 68. A torsion spring 143 acts between the rear wall 44 and the first tab 139 to bias the hub lever 128 into operative engagement with the retractor shoe 126.

Figure 24:
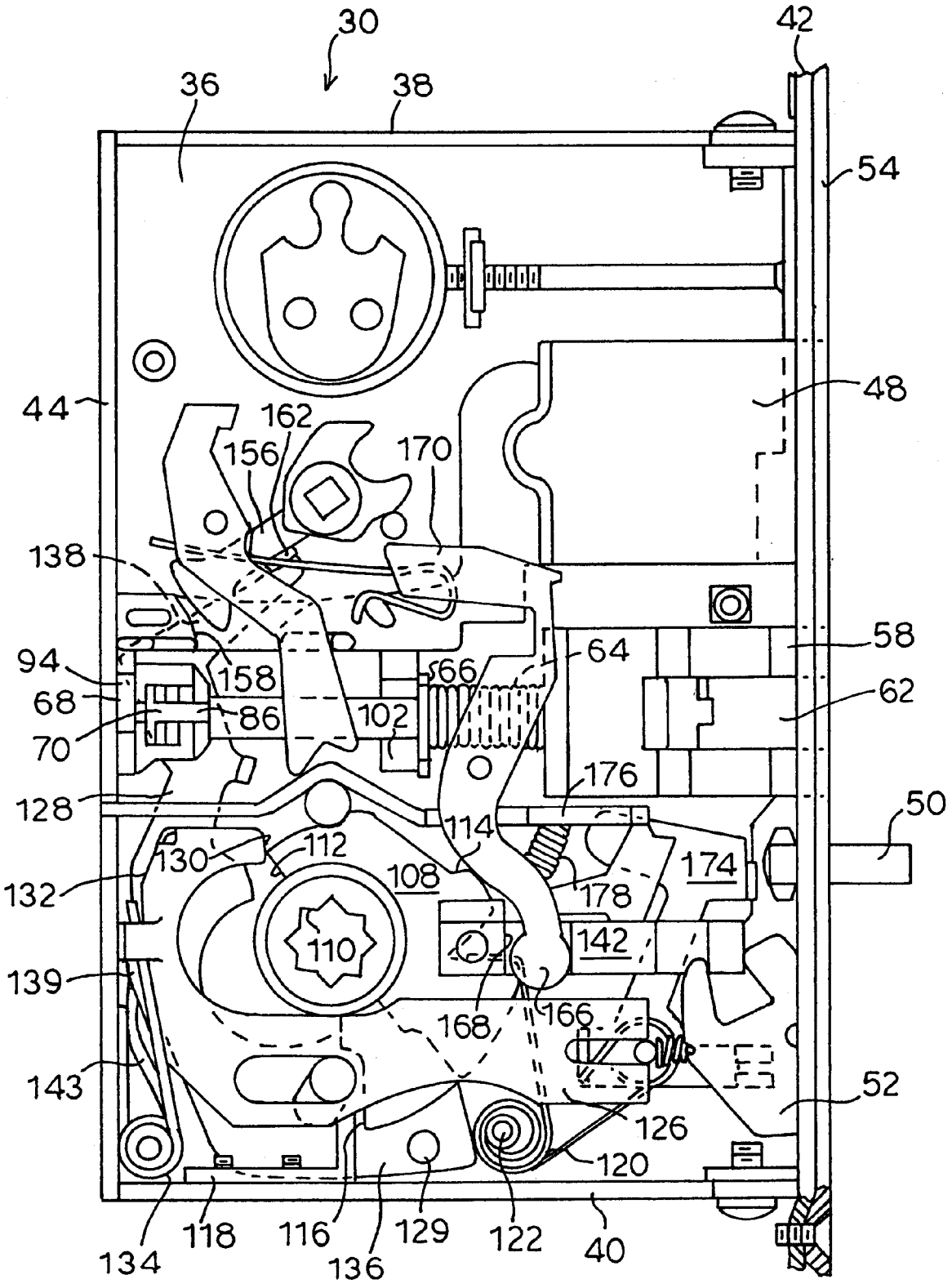
FIG. 24 is the same view of the mortise lock assembly of FIG. 2 but showing the latch bolt and deadbolt retracted into the case by actuation of a latch operator.

As seen in FIG. 24, the latch bolt 46 is retracted by rotating one of the rollback hubs 108. Rotation of the rollback hub 108 causes the rollback surface 112 to engage the bearing surface 130 of the retractor shoe 126 moving the shoe linearly rearward. The shoe's rearward bearing surface 132 engages the first hub lever tab 139 to pivot the hub lever 128 in a counterclockwise direction as seen in FIG. 24. The portion of the upper leg of 138 of the hub lever 128 adjacent the tail plate 68 acts against the retraction surface 92 of the tail plate 68 to move the tail plate and connected latch bolt 46 to the retracted position.

Figure 20:
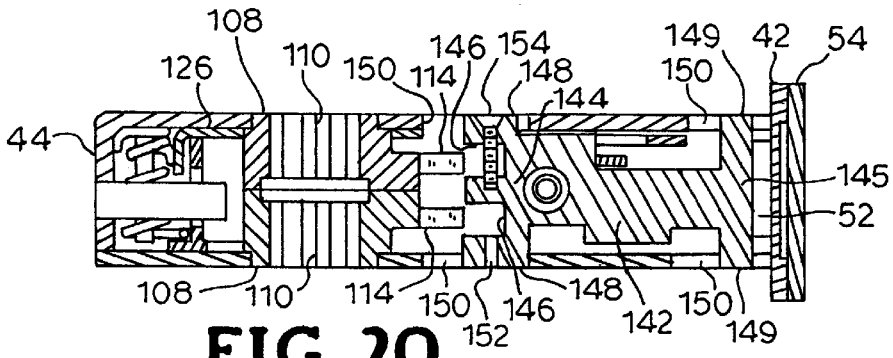
FIG. 20 is a sectional view of the mortise lock assembly of FIG. 2 taken along line 20—20 of FIG. 2 showing an embodiment of a locking mechanism used in the mortise lock assembly of FIG. 1 in an unlocked position.

The present invention is also concerned with the locking mechanism (FIG. 2) for selectively securing one or both of the retractor hubs 108 from rotation. The locking mechanism comprises an elongated slide plate 142 and the toggle 52. Referring to FIG. 20, the rearward end 144 of the slide plate 142 has two slots 146 for receiving a portion of the hubs 108 adjacent the respective bosses 114. Both ends 144, 145 of the slide plate 142 have opposed lateral tabs 148, 149 which ride in corresponding slots 150 in the side walls 34, 36 of the case for guiding and supporting linear movement of the slide plate 142 relative to the hubs 108. Each rear plate tab 148 has a transverse hole 152 which opens into the slots 146. The holes 152 are preferably threaded for receiving a blocking screw 154. The screw 154 is sufficiently long so that when the screw 154 is threaded into the tab 148 the screw extends into the slot 146.

Figure 22:
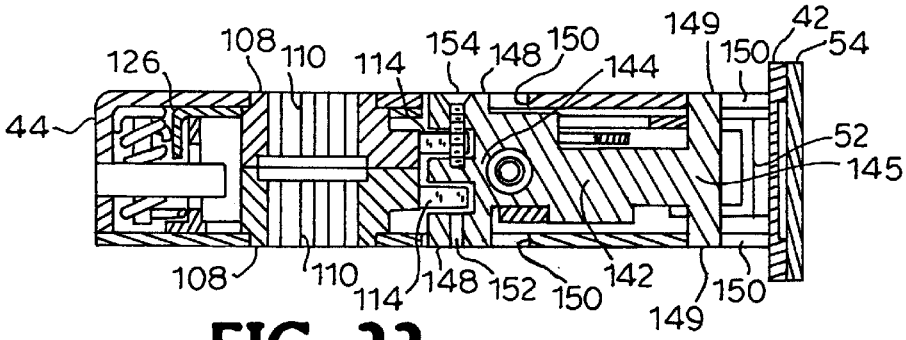
FIGS. 22 and 23 are the same views as FIGS. 20 and 21, respectively, but showing the locking mechanism embodiment in a locked position.
Figure 23:
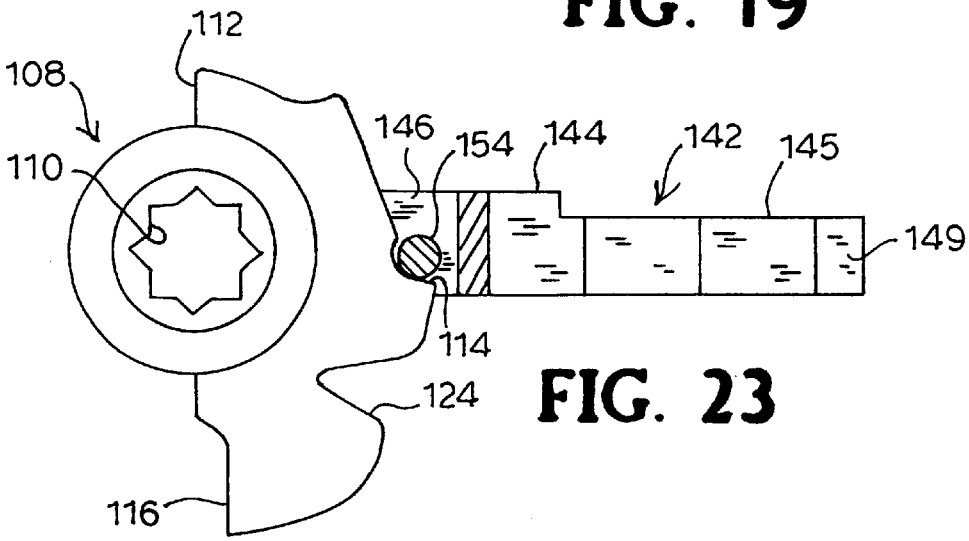
Figure 21:
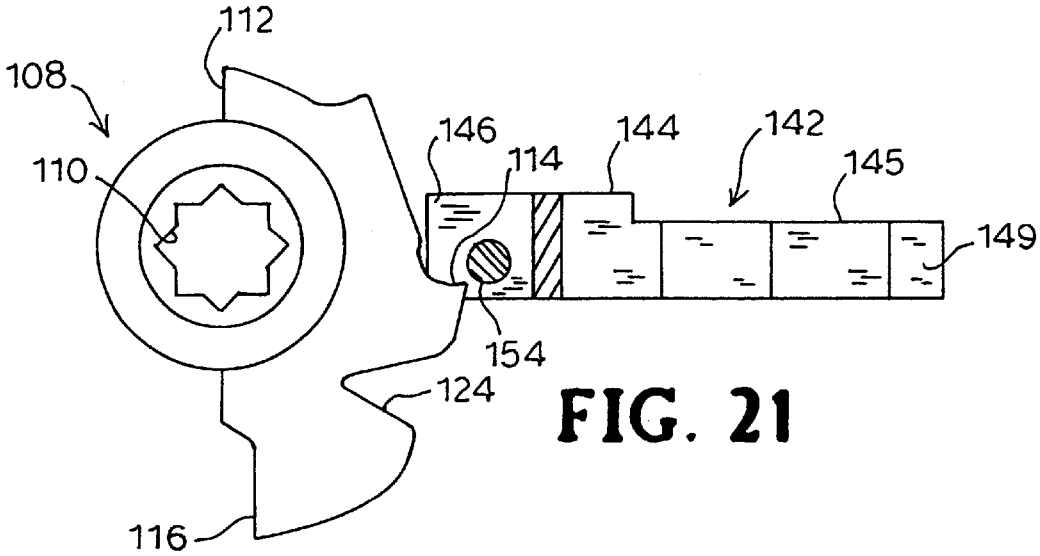
FIG. 21 is side elevational view a portion of the locking mechanism embodiment of FIG. 20 with other lock components removed.

The slide plate 142 is cooperatively linked to the toggle 52 which is accessible through the opening in the front wall 42 and face plate 54. Manipulation of the toggle 52 linearly reciprocates the slide plate 142 relative to the hubs 108 between an unlocked position (FIGS. 20 and 21) and a locked position (FIGS. 22 and 23). The locking mechanism is moved to the locked position by depressing the upper end of the toggle 52 thereby moving the slide plate 142 so that the rearward end 144 is positioned adjacent the hubs 108. When the locking mechanism is in the locked position, the screw 154 is in the path of the boss 114 on one of the retractor hubs 108 thereby preventing rotation of the hub 108. As noted above, the hub 108 preferably affected by the locking mechanism is on the outside of the door. Therefore, the screw 154 is preferably placed in the rear slide plate tab 148 corresponding to the outside hub 108 so as to prevent rotation of the outside hub and retraction of the latch bolt 46 from the outside when the lock is locked. The inside hub 108 can still turn to permit retraction of the latch bolt 46 since the hub boss 114 passes freely through the open slot 146 in the slide plate 142. If the mortise lock is reversed for installation in a door of the opposite hand, the screw 154 is simply moved to the opposite rear tab 148. Of course, in mortise locks using a single hub, the screw prevents rotation of both operators. Similarly, in the illustrated embodiment, a second stop screw can be used with the same effect. The locking mechanism is unlocked by depressing the lower end of the toggle 52 thereby moving the slide toward the front wall 42 of the case 32 and away from the hubs 108 (FIGS. 20 and 21).

Preferably, the mortise lock assembly includes the deadbolt 48 and the auxiliary bolt 50. The deadbolt 48 is selectively moved between an extended position and retracted position by operation of a key cylinder or thumb turn (not shown) in a conventional manner. The cylinder and thumb turn rotate a deadbolt lever 156 which engages the sides of a slot 158 in the rearward end 160 of the deadbolt 48 for extending or retracting the deadbolt. The upper leg 138 of the hub lever 128 has a second laterally projecting tab 162 for engaging the deadbolt lever 156 when the deadbolt 48 is in the extended position for retracting the deadbolt along with the latch bolt 46 in response to rotation of either hub 108 (FIG. 24).

A rotating stop lever 164 is provided for functionally connecting the deadbolt lever 156 and locking mechanism (FIG. 2). The lower end 166 of the stop lever 164 is positioned in a slot 168 in the slide plate 142 and the upper end 170 is arranged in the path of the deadbolt lever 156. When the deadbolt 48 is moved from the retracted position to the extended position the deadbolt lever 156 engages the upper end portion 170 of the stop lever 164 to rotate the lever in a clockwise direction (as seen in FIG. 2) and move the locking mechanism, including the slide plate 142 and toggle 52, to the locked position. Thus, the locking mechanism automatically moves to the locked position when the deadbolt 48 is moved to the extended position. The locking mechanism remains in this position, even when the deadbolt 48 is retracted by operation of one of the hubs 108 (FIG. 24), until the toggle 52 is actuated to move the slide plate 142 away from the hubs 108.

Means for deadlocking the latch bolt 46 in the extended position is also provided (FIG. 2). The deadlocking means 172 comprises the auxiliary bolt 50, a deadlocking lever 174 and an auxiliary latch lever 176. When the door is closed, the auxiliary bolt 50 is depressed by the door frame which allows the deadlocking lever 174 to pivot in a counterclockwise direction under the biasing force of a compression spring 178 to a position where the deadlocking lever prevents manual depression of the latch bolt 46. The deadbolt 48 also has a shoulder 180 which is adjacent the rear surface of the bolt head 58 when the deadbolt is extended also for preventing depression of the latch bolt 46.

Figure 25:
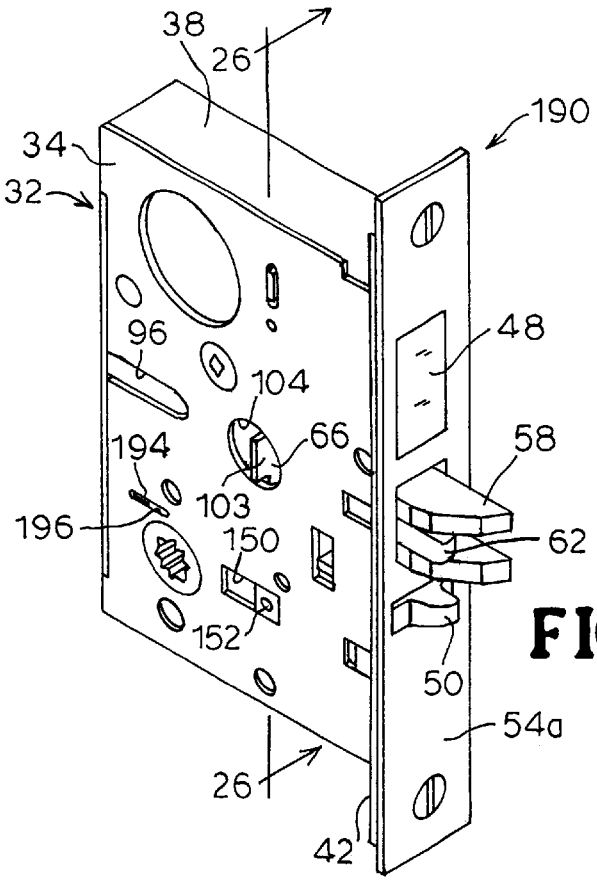
FIG. 25 is a perspective view of another embodiment of a mortise lock assembly according to the present invention.
Figure 26:
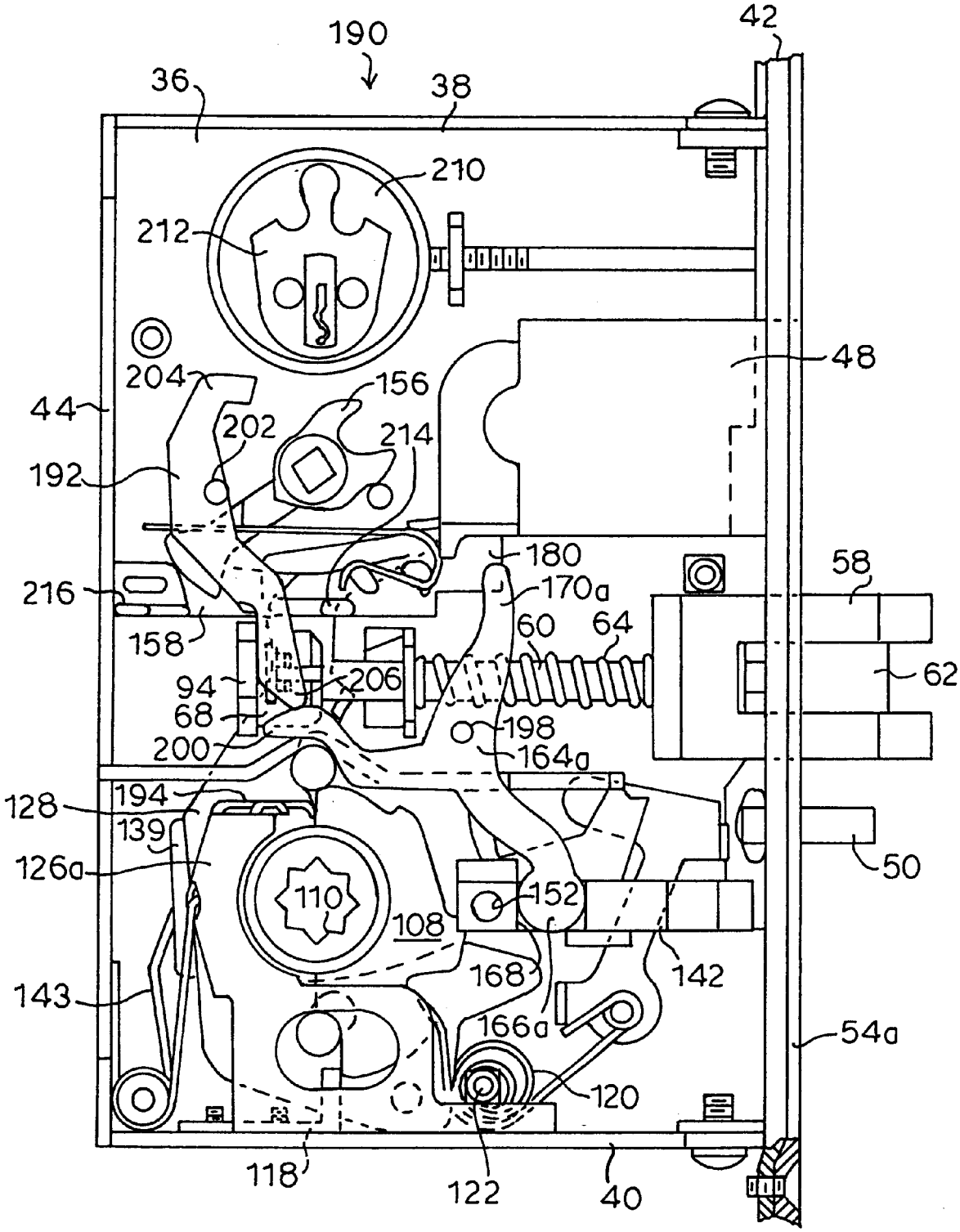
FIG. 26 is a side elevation view of the mortise lock assembly of FIG. 25 in the unlocked condition taken along line 26—26 of FIG. 25.

Referring now to FIG. 25, another embodiment of a mortise lock assembly according to the present invention is shown and is generally designated by reference numeral 190. FIG. 26 shows the mortise lock 190 with the cap side wall 34 removed and the lock in the unlocked condition with the deadbolt 48 in the retracted position. There are three components of the second embodiment of the mortise lock assembly 190 which differ from the components of the first embodiment of the mortise lock 30 described above: the retractor shoe 126*a*, the stop lever 164*a* and a latch lever 192. Also, there is no toggle 52 to operate the slide plate 142.

The retractor shoe 126*a* is substantially L-shaped, but smaller than the retractor shoe 126 shown in the first embodiment of the mortise lock assembly 30. The shoe 126*a* is mounted for linear movement within the case 32, with the front portion of the shoe 126*a* sliding between the bottom wall 40 and the post 122. The shoe 126*a* has a transverse boss 194 which fits in a slot 196 (FIG. 25) in the cap side wall 34 for guiding the linear movement of the shoe 126*a*.

Figure 28:
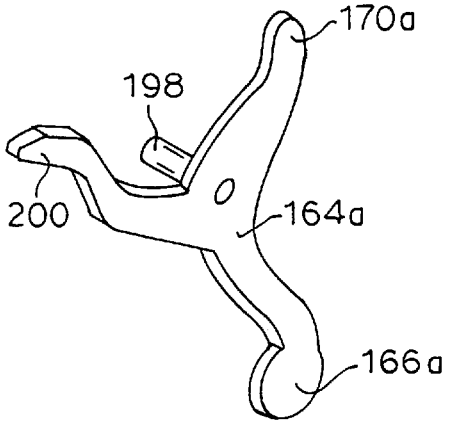
FIG. 28 is a perspective view of a latch lever used in the mortise lock assembly of FIG. 25.

The rotating stop lever 164*a* is Y-shaped (FIG. 28) and is pivotally mounted on a pin 198 in the case 32 at the intersection of the three legs. The lower leg 166*a* of the stop lever 164*a* is positioned in the slot 168 in the slide plate 142. The upper leg 170*a* of the stop lever 164*a* extends upwardly so that the distal end of the upper leg 170*a* is adjacent the path of the deadbolt 48. A third leg 200 of the stop lever 164*a* extends substantially rearwardly from the axis of rotation of the stop lever.

Figure 27:
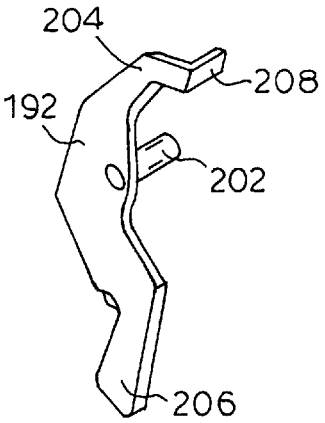
FIG. 27 is a perspective view of a stop lever used in the mortise lock assembly of FIG. 25.

The latch lever 192 (FIG. 27) is also pivotally mounted on a pin 202 in the case 32 at a point between the upper end 204 and lower end 206 of the latch lever. The upper end 204 of the latch lever 192 has a transverse tab 208. The lower end 206 of the latch lever 192 lies adjacent the tail plate 68.

As noted above, the deadbolt 48 may be selectively moved between an extended position and a retracted position by operation of a key cylinder in a conventional manner. A cylinder 210 is shown threaded into the case side wall 36 in FIG. 26. The cylinder 210 includes a key plug (not shown), the innerend of which carries an eccentric cam 212. Rotation of the plug by a key in the cylinder 210 causes corresponding rotation of the cam 212 which contacts the deadbolt lever 156 for extending or retracting the deadbolt 48. Preferably, a key cylinder is disposed in both sides wall 34, 36 of the case 32 allowing for key operation of the deadbolt 48 from the inside and outside of the door.

Figure 29:
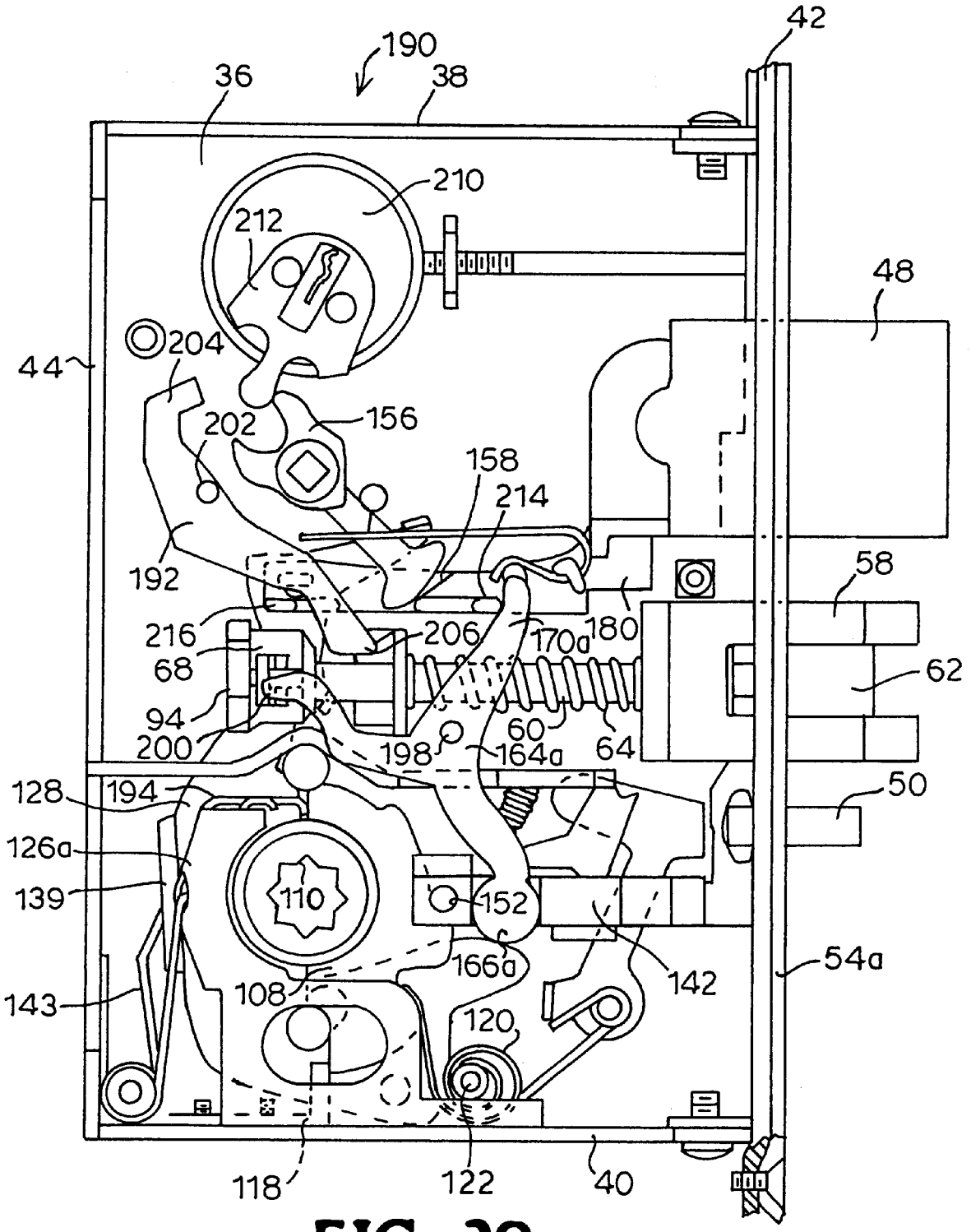
FIG. 29 is the same view of the mortise lock assembly of FIG. 26 but showing the mortise lock assembly in the locked condition with the deadbolt extended.

Clockwise rotation of the cam 212 (as seen in FIG. 26) moves the deadbolt 48 to the extended position (FIG. 29). As the deadbolt 48 moves to the extended position, a front boss 214 on the rearward end 160 of the deadbolt 48 engages the upper leg 170*a* of the stop lever 164*a* to rotate the stop lever in a clockwise direction. This causes the lower leg 166*a* of the stop lever 164*a* in the slot 168 in the slide plate 142 to move the slide plate to the locked position, as described above. Thus, the slide plate 142 is automatically moved to the locked position when the deadbolt 48 is moved to the extended position by rotation of the key in the cylinder 210. A rear boss 216 on the rearward end 160 of the deadbolt 48 carries the lower end 206 of the latch lever 192 slightly forward when the deadbolt 48 is thrown.

Figure 30:
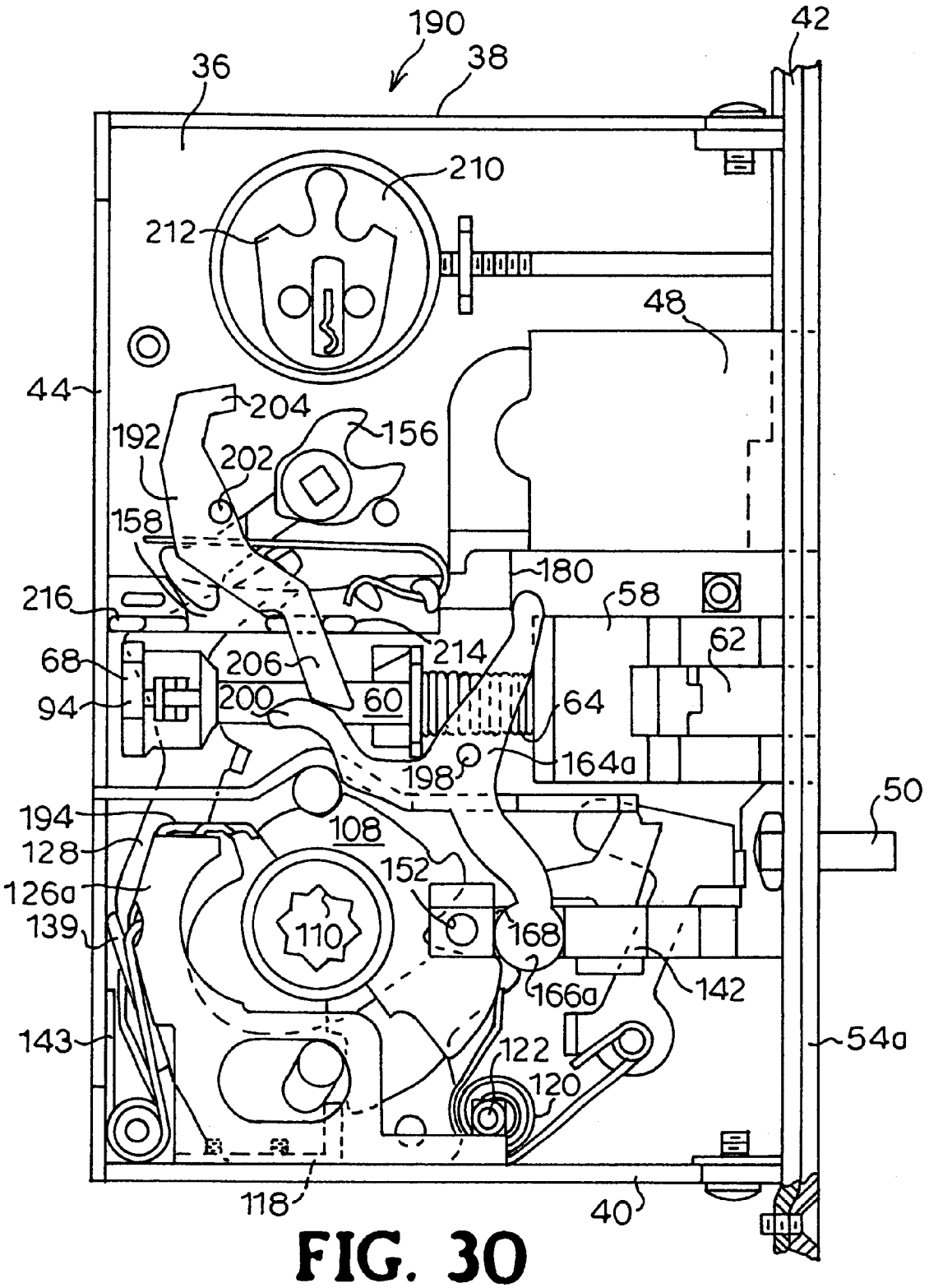
FIG. 30 is the same view of the mortise lock assembly of FIG. 26 or FIG. 29 but showing the latch bolt and deadbolt retracted into the case by actuation of a latch operator.

Preferably, when the lock 190 is in the locked condition, the inside latch operator is operable to retract the latch and deadbolt. The position of the lock components upon operation of the inside latch operator is shown in FIG. 30. As described above, when the latch operator is rotated for imparting rotation to the corresponding hub 108, the roll-back surface 112 on the hub engages the forwardly facing bearing surface 130*a* on the shoe 126*a* thereby moving the shoe toward the rear wall 44 of the case 32. The rear bearing surface 132*a* of the shoe 126*a* engages the hub lever 128 for retracting the latch bolt 46 and deadbolt 48.

Figure 31:
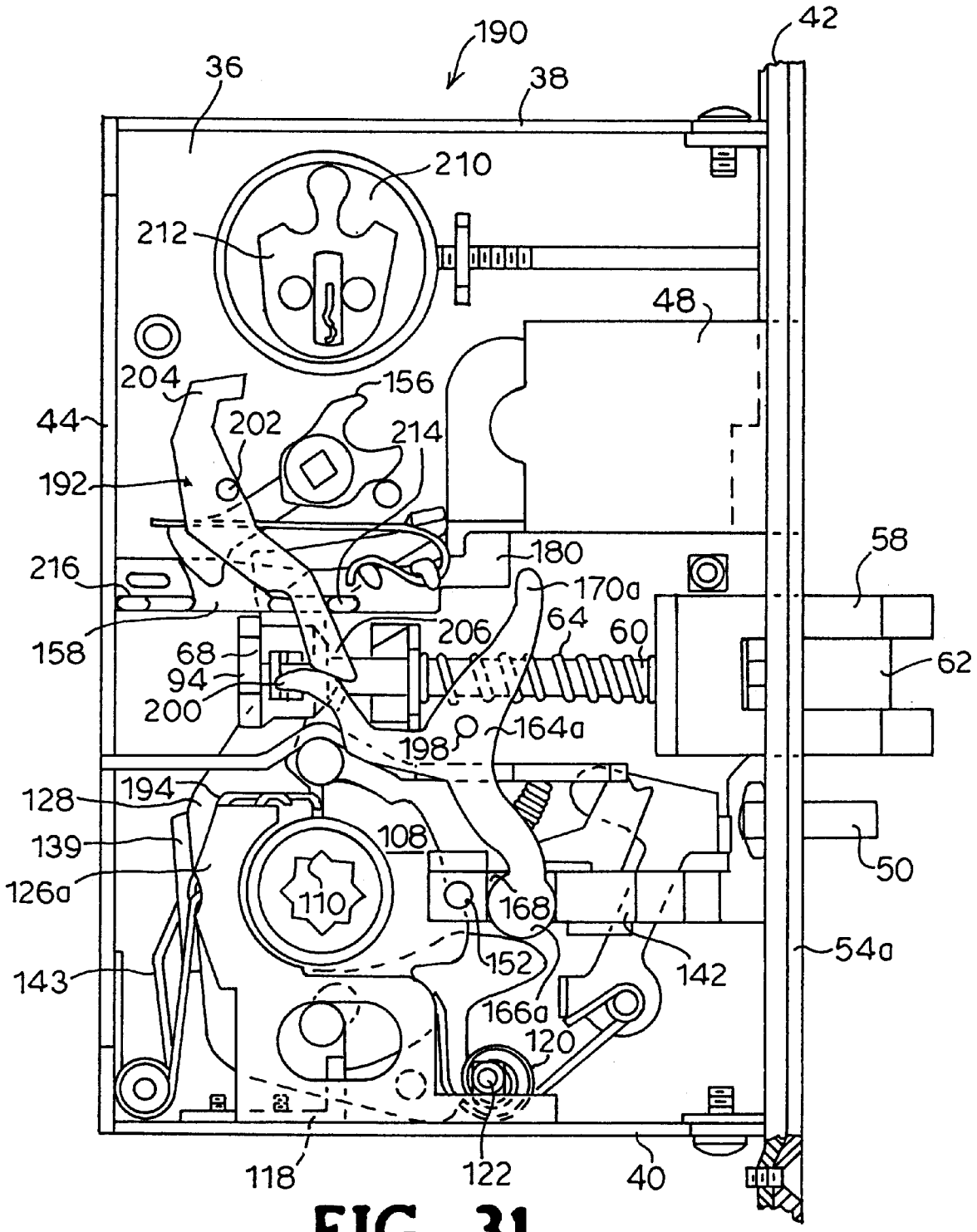
FIG. 31 is the same view of the mortise lock assembly of FIG. 26 but showing the mortise lock assembly in the locked condition with the deadbolt retracted.

When the latch operator is released, the components of the lock 190 assume the position shown in FIG. 31. The hub 108 and shoe 126*a* are biased to return to their neutral position and the coil spring 64 returns the latch bolt 46 to the extended position. However, the lock 190 remains locked with the slide plate 142 in the locked position adjacent the hubs 108. As seen in FIG. 31, the latch lever 192 rotates under the force of gravity so that the lower end 206 of the latch lever rests on the third leg 200 of the stop lever 164*a*. In this condition of the lock 190, the inside latch operator is operable to retract the latch bolt 46, but the outside latch operator is still locked against rotation. It is understood that rotation of the key in the cylinder 210 resulting in, for example, counterclockwise rotation of the cam 212 seen in FIG. 29, would retract the deadbolt 48 and place the lock components in the same position shown in FIG. 31.

Figure 32:
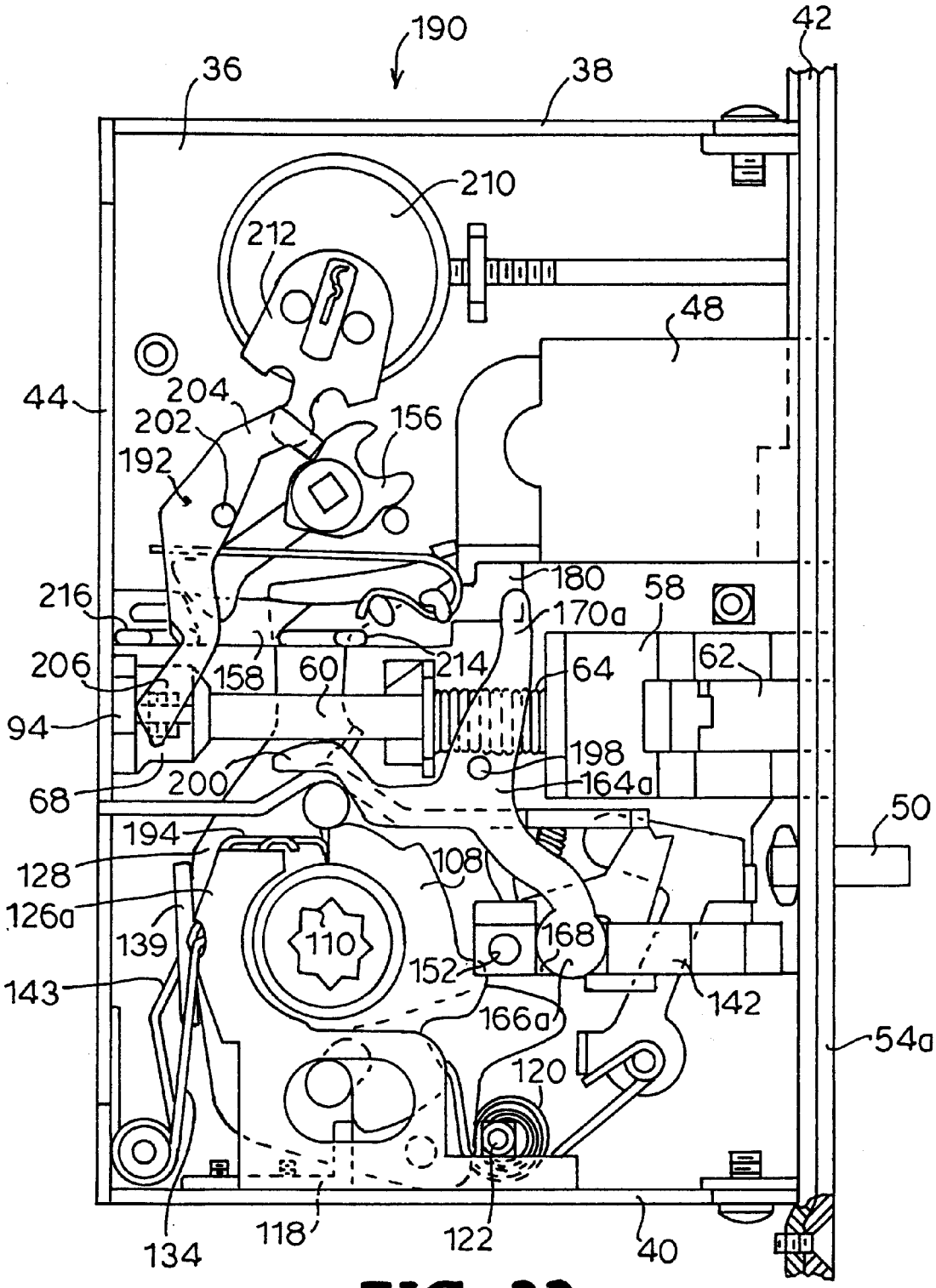
FIG. 32 is the same view of the mortise lock assembly of FIG. 26 or FIG. 29 but showing the latch bolt retracted into the case by actuation of a key-operated cylinder.

Unlocking the lock requires rotation of the key in the cylinder 210. As seen in FIG. 31, when the lock 190 is in the locked condition, the tab 208 (FIG. 27) on the latch lever 192 is disposed in the path of the eccentric cam 212. Rotation of the cam 212 in the counterclockwise direction will thus retract the latch bolt 46. As seen in FIG. 32, the cam 212 engages the tab 208 on the latch lever 192 to pivot the latch lever in a clockwise direction. The lower end 206 of the latch lever 192 engages the tail plate 68 to move the latch bolt 46 to the retracted position inside the case 32. This movement requires that the lower end 206 of the latch lever 192 move past the third leg 200 of the stop lever 164*a* thus rotating the stop lever in a counterclockwise direction causing the slide plate 142 to move toward the front wall 42 of the case 32 and away from the hubs 108. This movement of the slide plate 142 frees the outside latch operator for rotation. When the key is rotated for removal, the latch bolt 46 is returned to the extended position by the coil spring 64, carrying the latch lever 192. This movement places the lock 190 in the unlocked condition shown in FIG. 26. Thus, the lock 190 remains in the locked condition until the key cylinders are operated to move the slide plate 142 away from the hubs 108.

The operation of the lock may be summarized as follows. When the lock is in the unlocked condition, the latch bolt is retracted by actuating either the inside or outside latch operator. The lock is locked by extending the deadbolt using the inside or outside key cylinder. When in the locked condition, the outside latch operator is locked against rotation and the inside latch operator is functional to simultaneously retract the latch bolt and deadbolt. The outside or inside key cylinder will also retract the deadbolt and the latch bolt. Retracting latch bolt and deadbolt using the inside latch operator leaves the lock in the locked condition. Retracting the latch bolt by the outside or inside cylinder will place the lock in the unlocked condition, freeing the outside lever. Thus, the lock is locked and unlocked only by using the key cylinders while the inside lever is always free to retract the latch bolt or deadbolt.

An auxiliary latch 50 may be provided to deadlock the latch bolt when the door is closed. However, this is not a necessary feature and may be omitted. Omission of the auxiliary latch and toggle is easily accommodated by providing a face plate 54*a* with openings only for the latch bolt 46 and deadbolt 48.

Further, it is understood that the latch bolt and locking mechanism suitable for use in the embodiment of the present invention shown in FIGS. 25–32 may be conventional, as long as the locking mechanism is operatively connected to the stop lever for movement between a position where the locking mechanism prevents rotation of at least one of the latch operators and a position where the latch operators are free. Further, a thumb turn may be used on the inside of the lock to extend or retract the deadbolt. However, a thumb turn would allow anyone in the room to have access to the unlocking the lock. Thus, a key-operated cylinder is preferred since only the person with the key would have access to the lock.

The previously described embodiments of the present invention have many advantages, including providing a mortise lock with a high degree of security. When used as a classroom lock, the new mortise lock offers the security of a deadbolt. Further, the high security features are contollable from the inside and outside of the door, which allows a teacher to lock or unlock the door by throwing the deadbolt from inside or outside of the room. She can lock herself and the children in the room from inside, or just herself while working after school, and feel more secure. The mortise lock of the present invention also provides a reversible mortise lock which cannot be tampered with after installation. Moreover, because the latch bolt reversal relies on removal of the entire latch bolt from the case rather than partial removal, the bolt head can be as long as is practical thereby providing greater strength and security for the lock. The mortise lock incorporating the new latch assembly and locking mechanism is easily modified from outside of the lock casing with a screw driver for use with either a right-hand door or a left-hand door. In either arrangement, the latch operators are operable to open the door when the lock is unlocked. When the lock is locked, rotation of the outside latch operator is prevented, whereas the inside latch operator is still operable to open the door. With the addition of another blocking screw, the inside latch operator can also be locked against rotation.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, a single rollback hub can replace the two, independent hubs so that the locking mechanism affects both the inside and outside latch operators. Accordingly, we intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. A mortise lock, the lock comprising:

a housing;

a latch bolt mounted in the housing for movement relative to the housing between an extended position where a portion of the latch bolt extends outside of the housing and a retracted position where the latch bolt is inside of the housing;

a deadbolt mounted in the housing for movement relative to the housing between a retracted position where the deadbolt is inside the housing and an extended position where a portion of the deadbolt extends outside of the housing;

first means for moving the deadbolt between the retracted and extended positions of the deadbolt;

second means for moving the latch bolt to the retracted position of the latch bolt and the deadbolt to the retracted position of the deadbolt, the second moving means including a moveable member in the housing;

a blocking element mounted in the housing for movement between a first position and a second position, the blocking element adapted in the second position of the blocking element to prevent movement of the moveable member;

a locking lever moveably mounted in the housing, the locking lever operatively connecting the deadbolt and the blocking element so that when the deadbolt is moved from the retracted position to the extended position of the deadbolt, the blocking element is moved from the first position to the second position of the blocking element; and a latch lever moveably mounted in the housing, the latch lever operatively connecting the first moving means and the locking lever when the blocking element is in the second position of the blocking element and the deadbolt is in the retracted position of the deadbolt for moving the blocking element to the first position by operation of the first moving means.

2. A mortise lock as recited in claim 1, wherein the first moving means comprises a key-operated cylinder.

3. A mortise lock as recited in claim 2, wherein the key-operated cylinder extends inwardly from the exterior of the housing and comprises a cam disposed in the housing for operation by the cylinder, the cam movable about an axis for engaging and moving the latch lever causing the locking lever to drive the blocking element to the first position.

4. A mortise lock as recited in claim 1, wherein the blocking element has an opening adapted to receive a portion of the moveable member in the second position of the blocking element for allowing the moveable member to move, and wherein a removable stop is positioned in the opening.

5. A mortise lock as recited in claim 4, wherein the moveable member is a rotating hub having a blocking surface which is engaged by the stop in the second position of the blocking element to prevent rotation of the hub.

6. A mortise lock as recited in claim 1, wherein the second moving means comprises a manually operable latch operator accessible from the exterior of the housing and the moveable member comprises a rotating hub keyed to the latch operator and journalled for rotation in the housing, and wherein the blocking element is spaced from the hub in the first position of the blocking element and engages the hub for preventing rotation of the hub and the latch operator in the second position of the blocking element.

7. A mortise lock as recited in claim 1, wherein the locking lever comprises a rigid lever mounted in the housing for pivotal movement about a pivot axis which extends transversely to the direction of movement of the locking lever, the locking lever including first and second arms extending radially outwardly from the pivot axis, the first arm operatively connected to the blocking element so that the lever pivots between a first position and a second position when the blocking element moves between the first position and second position of the blocking element, and the second arm positioned adjacent the deadbolt, the deadbolt having an engagement surface which engages the second arm when the deadbolt moves from the retracted position to the extended position for pivoting the locking lever to the second position of the locking lever causing the locking lever to drive the blocking element to the second position.

8. A mortise lock as recited in claim 7, wherein the locking lever includes a third arm extending radially outwardly from the pivot axis, and the latch lever comprises a rigid lever mounted in the housing for pivotal movement from a first position to a second position about a pivot axis which extends transversely to the direction of movement the latch lever, the latch lever including first and second arms extending radially outwardly from the pivot axis, the first arm of the latch lever engaging the third arm of the locking lever when the latch lever is in the first position and the blocking element and locking lever are in their second positions and the deadbolt is in the retracted position of the deadbolt so that operation of the first moving means to pivot the latch lever to the second position pivots the locking lever to the first position of the locking lever causing the locking lever to drive the blocking element to the first position of the blocking element.

9. A mortise lock, the lock comprising:

a housing;

a latch bolt mounted in the housing for movement relative to the housing between an extended position where a portion of the latch bolt extends outside of the housing and a retracted position where the latch bolt is inside of the housing;

a deadbolt mounted in the housing for movement relative to the housing between a retracted position where the deadbolt is inside the housing and an extended position where a portion of the deadbolt extends outside of the housing;

first means for moving the deadbolt between the retracted and extended positions of the deadbolt;

second means for moving the latch bolt to the retracted position of the latch bolt and the deadbolt to the retracted position of the deadbolt, the second moving means including a moveable member in the housing;

a blocking element mounted in the housing for movement between a first position and a second position, the blocking element adapted in the second position of the blocking element to prevent movement of the moveable member;

a locking lever moveably mounted in the housing, the locking lever operatively connecting the deadbolt and the blocking element so that when the deadbolt is moved from the retracted position to the extended position of the deadbolt, the blocking element is moved from the first position to the second position of the blocking element;

a latch lever moveably mounted in the housing, the latch lever operatively connecting the first moving means and the locking lever when the blocking element is in the second position of the blocking element and the deadbolt is in the retracted position of the deadbolt for moving the blocking element to the first position by operation of the first moving means; and a securing member disposed inside the housing and releasably attached to the latch bolt, the securing member moveable relative to the housing between a first position and a second position so that in the first position of the securing member the latch bolt is in the retracted position and in the second position of the securing member the latch bolt is in the extended position and a portion of the latch bolt remains within the housing, and wherein the second moving means operates to move the securing member to the first position.

10. A mortise lock as recited in claim 9, wherein the second portion of the latch bolt comprises a rod and the securing member comprises an opening for receiving the rod.

11. A mortise lock as recited in claim 10, wherein the securing member comprises:

a securing element movably mounted to the securing member, the securing element having a blocking surface; and means for biasing the securing element into a blocking position where the blocking surface partially closes the opening in the securing member and into engagement with the rod for securing the latch bolt in the securing member.

12. A mortise lock as recited in claim 11, wherein the securing element comprises a substantially flat plate having an opening and the blocking surface comprises an edge of the plate defining the opening, and wherein the securing member has a slot for receiving the plate so that the openings in the plate and securing member are partially aligned when the biasing means biases the plate into the blocking position.

13. A mortise lock as recited in claim 11, wherein the securing element further comprises a first surface which when pressed moves the securing element against the force of the biasing means to a releasing position where the blocking surface is out of the opening in the securing member for removing the latch bolt from the securing member and out of the housing.

14. A mortise lock as recited in claim 13, wherein the first surface of the securing element is accessible from outside of the lock housing.

15. A security mechanism for a mortise lock assembly of the type comprising a housing for accommodating the lock components including the security mechanism, a latch bolt mounted in the housing for movement relative to the housing between an extended position where a portion of the latch bolt extends outside of the housing and a retracted position where the latch bolt is inside of the housing, a deadbolt mounted in the housing for movement relative to the housing between a retracted position where the deadbolt is inside the housing and an extended position where a portion of the deadbolt extends outside of the housing, first means for moving the deadbolt between the retracted and extended positions of the deadbolt, second means for moving the latch bolt to the retracted position of the latch bolt and the deadbolt to the retracted position of the deadbolt, the second moving means including a moveable member in the housing, a blocking element mounted in the housing for movement between a first position and a second position, the blocking element adapted in the second position of the blocking element to prevent movement of the moveable member, a locking lever moveably mounted in the housing, the locking lever operatively connecting the deadbolt and the blocking element so that when the deadbolt is moved from the retracted position to the extended position of the deadbolt, the blocking element is moved from the first position to the second position of the blocking element, the security mechanism comprising:

am arm member integral with the locking lever, and a latch lever moveably mounted in the housing, the latch lever adapted to operatively interengage the first moving means and the arm member when the blocking element is in the second position of the blocking element and the deadbolt is in the retracted position of the deadbolt so that the blocking element is moveable to the first position by operation of the first moving means.

16. A security mechanism for a mortise lock as recited in claim 15, wherein the first moving means comprises a key-operated cylinder.

17. A security mechanism for a mortise lock as recited in claim 15, wherein the latch lever comprises a rigid lever adapted to be mounted in the housing for pivotal movement from a first position to a second position about a pivot axis which extends transversely to the direction of movement the latch lever, the latch lever including first and second arms extending radially outwardly from the pivot axis, the first arm of the latch lever engaging the locking lever arm when the latch lever is in the first position and the blocking element is in the second position and the deadbolt is in the retracted position of the deadbolt so that, upon operation of the first moving means to pivot the latch lever to the second position, the latch lever moves the locking lever to the first position of the locking lever causing the locking lever to drive the blocking element to the first position of the blocking element.

18. A mortise lock, the lock comprising:

a housing;

a latch bolt mounted in the housing for movement relative to the housing between an extended position where a portion of the latch bolt extends outside of the housing and a retracted position where the latch bolt is inside of the housing;

a deadbolt mounted in the housing for movement relative to the housing between a retracted position where the deadbolt is inside the housing and an extended position where a portion of the deadbolt extends outside of the housing;

a manually operable actuator extending inwardly from the exterior of the housing for moving the deadbolt between the retracted and extended positions of the deadbolt, the actuator including a cam disposed in the housing for movement about an axis;

a manually operable latch operator accessible from the exterior of the housing;

a hub journalled for rotation in the housing and keyed to the latch operator;

a retractor arm operably connected between the hub, the latch bolt and the deadbolt for moving the latch bolt to the retracted position of the latch bolt and the deadbolt to the retracted position of the deadbolt upon rotation of the latch operator and hub;

a blocking element mounted in the housing for movement between a first position and a second position, the blocking element spaced from the hub in the first position of the blocking element and adapted to engage the hub in the second position of the blocking element to prevent rotation of the hub and latch operator;

a rigid locking lever mounted in the housing for pivotal movement about a pivot axis which extends transversely to the direction of movement of the locking lever, the locking lever including first, second and third arms extending radially outwardly from the pivot axis, the first arm operatively connected to the blocking element so that the locking lever pivots between a first position and a second position when the blocking element moves between the first position and second position of the blocking element, and the second arm positioned adjacent the deadbolt, the deadbolt having an engagement surface which engages the second arm when the deadbolt moves from the retracted position to the extended position for pivoting the locking lever to the second position of the locking lever causing the locking lever to drive the blocking element to the second position; and a rigid latch lever mounted in the housing for pivotal movement from a first position to a second position about a pivot axis which extends transversely to the direction of movement the latch lever, the latch lever including first and second arms extending outwardly from the pivot axis, the first arm of the latch lever engaging the third arm of the locking lever when the latch lever is in the first position and the blocking element and locking lever are in their second positions and the deadbolt is in the retracted position of the deadbolt, the second arm of the latch lever in the path of movement of the cam when the latch lever is in the first position of the latch lever so that operation of the manual actuator moves the latch lever to the second position and the latch lever pivots the locking lever to the first position of the locking lever causing the locking lever to drive the blocking element to the first position freeing the hub and latch operator for rotation.

19. A mortise lock as recited in claim 18, wherein the manually operable actuator comprises a thumb turn.

20. A mortise lock as recited in claim 18, wherein the manually operable actuator comprises a key-operated cylinder.

* * * * *